US012515115B2

(12) United States Patent
Hoeffner et al.

(10) Patent No.: US 12,515,115 B2
(45) Date of Patent: Jan. 6, 2026

(54) EQUIPMENT FEEDBACK SYSTEM

(71) Applicants: Catherine Angela Hoeffner, Malvern, PA (US); Elizabeth Ann Hoeffner, Malvern, PA (US); Patrick Joseph Hoeffner, Malvern, PA (US)

(72) Inventors: Catherine Angela Hoeffner, Malvern, PA (US); Elizabeth Ann Hoeffner, Malvern, PA (US); Patrick Joseph Hoeffner, Malvern, PA (US)

( * ) Notice: Subject to any disclaimer, the term of this patent is extended or adjusted under 35 U.S.C. 154(b) by 284 days.

(21) Appl. No.: 16/536,098

(22) Filed: Aug. 8, 2019

(65) Prior Publication Data

US 2020/0047040 A1 Feb. 13, 2020

Related U.S. Application Data

(60) Provisional application No. 62/715,852, filed on Aug. 8, 2018.

(51) Int. Cl.

| | |
|---|---|
| ***A63B 59/20*** | (2015.01) |
| ***A63B 24/00*** | (2006.01) |
| ***A63B 71/06*** | (2006.01) |
| ***A63B 102/14*** | (2015.01) |

(52) U.S. Cl.

CPC ..... *A63B 59/20* (2015.10); *A63B 24/0003* (2013.01); *A63B 2071/0655* (2013.01); *A63B 2102/14* (2015.10); *A63B 2220/16* (2013.01); *A63B 2220/56* (2013.01); *A63B 2225/50* (2013.01)

(58) Field of Classification Search

CPC ..... A63B 59/20; A63B 2102/14; A63B 60/10; A63B 2220/833; A63B 71/0622; A63B 2225/50; A63B 2220/80; A63B 2225/20; A63B 24/0003; A63B 2071/0655; A63B 2220/16; A63B 2220/56

See application file for complete search history.

(56) References Cited

U.S. PATENT DOCUMENTS 3,270,564 A * 9/1966 Evans ..... A63B 69/3632 73/865.4
3,717,857 A * 2/1973 Evans ..... A61B 5/1107 340/870.13

(Continued)

OTHER PUBLICATIONS

Lee W. Young. PCT International Search Report. Oct. 29, 2019.
Lee W. Young. PCT Written Opinion of the International Searching Authority. Oct. 29, 2019.

*Primary Examiner* — Eugene L Kim
*Assistant Examiner* — Amir A Klayman
(74) *Attorney, Agent, or Firm* — Roy Kiesel Ford Doody & North, APLC; Chad A. Grand

(57) ABSTRACT

In the specification and drawings an equipment feedback system is shown and described with an equipment body; a power source structure connected to the equipment body; a pressure sensor connected to the power source structure; a position sensor connected to the power source structure; and an indicator in communication with the pressure sensor and the position sensor, wherein the indicator is capable of providing an indication to a user that the equipment body is held in a proper position by a user based on information generated by the pressure sensor and the position sensor.

41 Claims, 5 Drawing Sheets

(56) References Cited

U.S. PATENT DOCUMENTS 3,788,647 A * 1/1974 Evans ..... A61B 5/0002 473/223
3,806,131 A * 4/1974 Evans ..... A63B 69/3632 473/223
3,945,646 A * 3/1976 Hammond ..... A63B 24/0003 473/223
5,221,088 A * 6/1993 McTeigue ..... A63B 24/0003 434/252
5,439,217 A * 8/1995 Ganger, Sr. ..... A63B 69/3635 473/202
5,651,744 A * 7/1997 Millon ..... A63B 59/20 473/513
5,969,296 A * 10/1999 Yamamoto ..... G06F 3/03545 178/18.01
6,001,023 A * 12/1999 Sanchez ..... A63B 69/3635 473/217
6,083,125 A * 7/2000 West ..... A63B 60/22 473/549
6,515,593 B1 * 2/2003 Stark ..... A61B 5/411 128/903
7,114,398 B2 * 10/2006 Haines ..... A63B 24/00 73/779
7,267,281 B2 * 9/2007 Hopkins ..... A61H 3/061 135/911
7,282,000 B2 * 10/2007 Brine, III ..... A63B 60/54 473/513
7,744,482 B1 * 6/2010 Watson ..... A63B 24/0021 473/221
7,775,227 B2 * 8/2010 Jackson ..... A61H 3/02 135/66
8,192,242 B2 * 6/2012 Luecker ..... A61B 5/224 440/101
8,449,410 B1 * 5/2013 Kaufman ..... A63B 69/38 473/549
8,690,705 B2 * 4/2014 Molinari ..... A63B 53/06 473/331
8,840,483 B1 * 9/2014 Steusloff ..... A63B 60/16 473/222
8,944,929 B1 * 2/2015 Smith ..... A63B 53/14 473/202
9,452,338 B1 * 9/2016 Nickles, Jr. ..... A63B 69/3608
9,826,806 B2 * 11/2017 Challa ..... A45B 3/02
10,016,158 B2 * 7/2018 Donohoe ..... A61B 5/6895
10,186,129 B2 * 1/2019 Hood ..... G08B 21/02
11,376,465 B2 * 7/2022 Scheinberg ..... A63B 21/00185
2003/0170599 A1 * 9/2003 Hart ..... A63B 69/3623 434/252
2004/0176194 A1 * 9/2004 Mitchell ..... A63B 21/0608 473/437
2004/0259651 A1 * 12/2004 Storek ..... A63B 69/3632 473/131
2005/0005467 A1 * 1/2005 Hannel ..... G01B 5/18 33/542
2005/0014607 A1 * 1/2005 Olkkonen ..... A63B 69/0028 482/8
2005/0037862 A1 2/2005 Hagood et al.
2005/0148402 A1 * 7/2005 Welles ..... A63B 15/00 473/219
2005/0282666 A1 * 12/2005 Morrow ..... A63B 60/06 473/513
2006/0025229 A1 * 2/2006 Mahajan ..... A63B 24/0003 473/131
2007/0110278 A1 * 5/2007 Vock ..... A63B 69/0093 382/103
2007/0167248 A1 * 7/2007 Fler ..... G02B 23/105 473/220
2008/0133171 A1 * 6/2008 Feichtinger ..... G01C 22/006 702/141
2008/0195005 A1 * 8/2008 Horst ..... A61H 1/0218 601/22
2008/0242435 A1 * 10/2008 Cho ..... A63B 53/007 473/223
2009/0143159 A1 * 6/2009 Murph ..... A63B 69/3632 473/239
2009/0171788 A1 * 7/2009 Tropper ..... A61B 5/743 705/14.61
2010/0151957 A1 * 6/2010 Hohla ..... A63B 69/3658 473/221
2010/0274304 A1 * 10/2010 Wang ..... A61B 5/112 607/3
2010/0311516 A1 * 12/2010 Papa, Jr. ..... A63B 69/3667 473/269
2011/0183787 A1 7/2011 Schwenger et al.
2011/0214501 A1 * 9/2011 Ross ..... A43B 3/0005 73/172
2011/0224012 A1 * 9/2011 Hashimoto ..... A63B 60/42 473/223
2012/0034989 A1 * 2/2012 Novosel, Sr. ..... A63B 69/3632 473/242
2012/0322569 A1 * 12/2012 Cottam ..... A63B 69/3632 473/223
2013/0165246 A1 * 6/2013 Jeffery ..... A63B 60/42 473/223
2013/0197743 A1 * 8/2013 Lindskov ..... G01S 15/08 701/34.4
2013/0237341 A1 * 9/2013 Smith ..... A63B 53/007 473/313
2013/0244816 A1 * 9/2013 Lignelli ..... A63B 60/08 473/513
2013/0346021 A1 * 12/2013 Stevens ..... G16H 40/63 702/160
2014/0206481 A1 7/2014 Zuger
2014/0213382 A1 * 7/2014 Kang ..... A63B 69/3632 473/223
2014/0295983 A1 * 10/2014 Nooner ..... A63B 24/0003 473/223
2014/0378277 A1 * 12/2014 Krullaards ..... A61B 5/021 482/8
2015/0032410 A1 * 1/2015 Postelnik ..... G09B 19/0038 702/153
2015/0051009 A1 * 2/2015 Davenport ..... A63B 53/04 473/223
2015/0057111 A1 * 2/2015 Tremblay-Munger ..... A63B 60/00 473/446
2015/0120021 A1 4/2015 Kerhuel
2015/0151178 A1 6/2015 Arner et al.
2015/0174465 A1 * 6/2015 Bowen ..... G06Q 10/0639 473/221
2015/0251071 A1 * 9/2015 Steusloff ..... A43B 3/0005 702/141
2016/0011091 A1 * 1/2016 Huang ..... G01N 3/24 73/841
2016/0038780 A1 * 2/2016 Hugou ..... A47C 9/025 482/8
2016/0151696 A1 * 6/2016 Chen ..... A63B 47/002 473/199
2016/0317866 A1 * 11/2016 Fung ..... A63B 22/06
2016/0346659 A1 * 12/2016 April ..... A63F 13/245
2017/0001072 A1 * 1/2017 Brekke ..... G16H 20/30
2017/0007880 A1 * 1/2017 Kano ..... A63B 24/0006
2017/0100586 A1 * 4/2017 Akiba ..... G16H 20/30
2017/0136296 A1 * 5/2017 Barrera ..... H04Q 9/00
2017/0151461 A1 6/2017 Appleton et al.
2017/0157480 A1 * 6/2017 Matsunaga ..... A63B 60/46
2017/0173388 A1 6/2017 Goldberg
2017/0189782 A1 * 7/2017 Jones ..... A63B 69/3623
2017/0216665 A1 * 8/2017 Mahr ..... A61B 5/6895
2017/0216692 A1 * 8/2017 Terada ..... A63B 60/46
2017/0232309 A1 * 8/2017 Dolezel ..... A63B 53/00 473/282
2017/0246521 A1 * 8/2017 deGreef ..... G01L 5/0052
2017/0248420 A1 * 8/2017 Fyfe ..... G01L 5/162
2017/0354844 A1 * 12/2017 Nomura ..... A63B 60/46
2018/0036624 A1 * 2/2018 Muuli ..... A63C 11/221
2018/0064992 A1 * 3/2018 Rothman ..... A63B 21/00181
2018/0116895 A1 * 5/2018 Ikeuchi ..... A61H 1/024
2018/0177672 A1 * 6/2018 Uchida ..... A63B 21/00
2018/0207465 A1 * 7/2018 Kaye ..... A63B 15/005

(56) References Cited

U.S. PATENT DOCUMENTS

| | | | | |
|---|---|---|---|---|
| 2018/0250571 | A1* | 9/2018 | Ito | G09B 1/00 |
| 2018/0264319 | A1* | 9/2018 | Gonzales | A63B 60/46 |
| 2018/0353791 | A1* | 12/2018 | Hugou | A63B 23/0205 |
| 2019/0038947 | A1* | 2/2019 | Ding | A63B 24/0062 |
| 2019/0038955 | A1* | 2/2019 | Hansen | A63B 43/00 |
| 2019/0060735 | A1* | 2/2019 | Wu | A61B 5/6895 |
| 2019/0299055 | A1* | 10/2019 | Poulsen | A63B 21/0088 |
| 2019/0344139 | A1* | 11/2019 | Amarant | A63B 53/04 |
| 2019/0347956 | A1* | 11/2019 | Daga | G09B 9/00 |

* cited by examiner

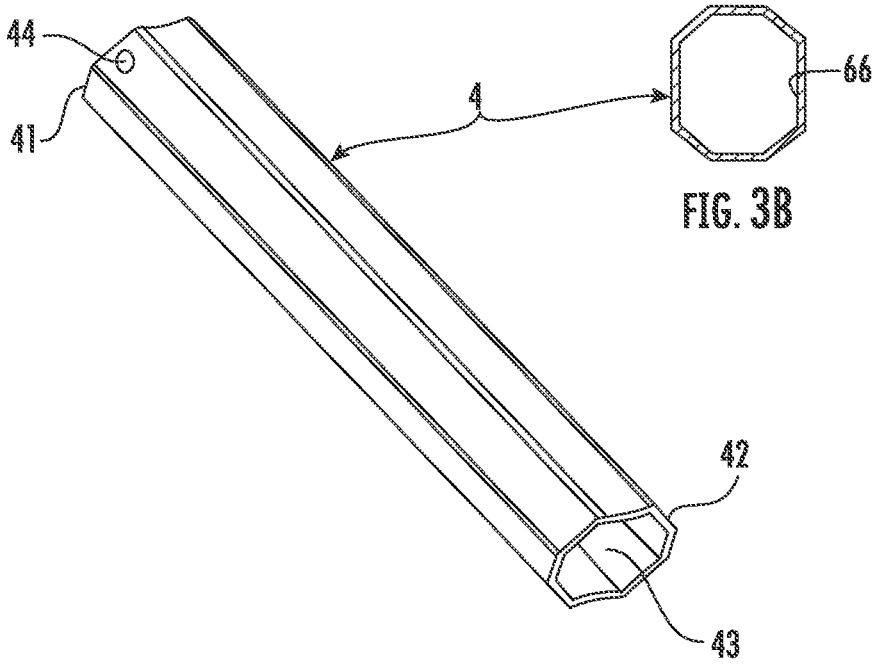
FIG. 3B
FIG. 3A
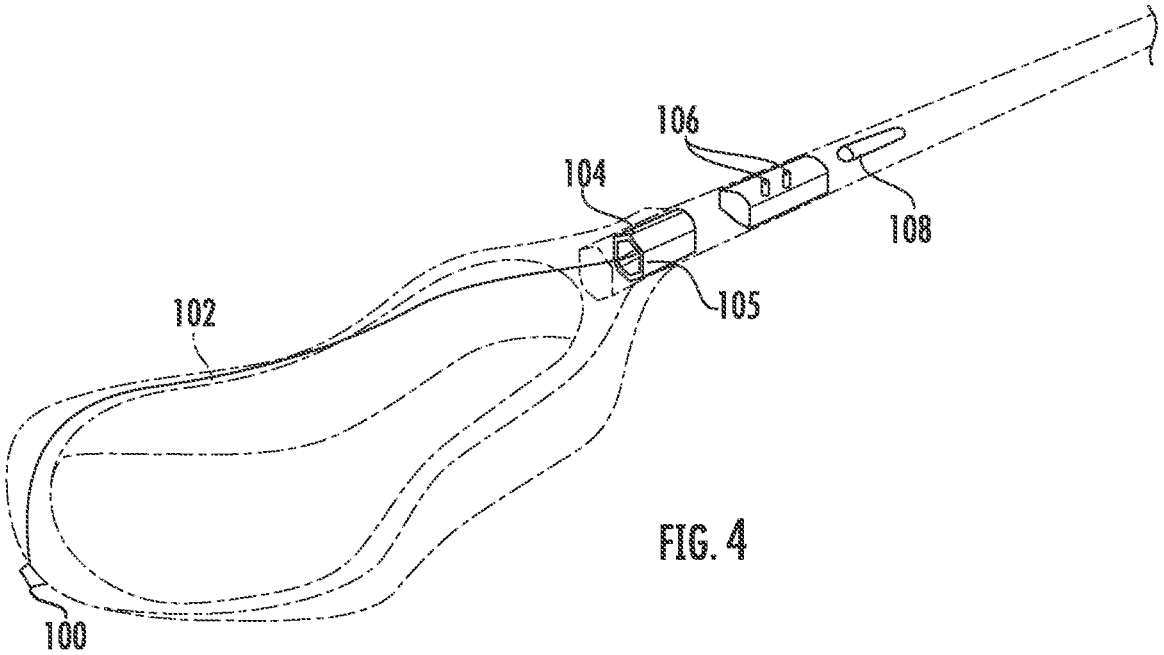
FIG. 4

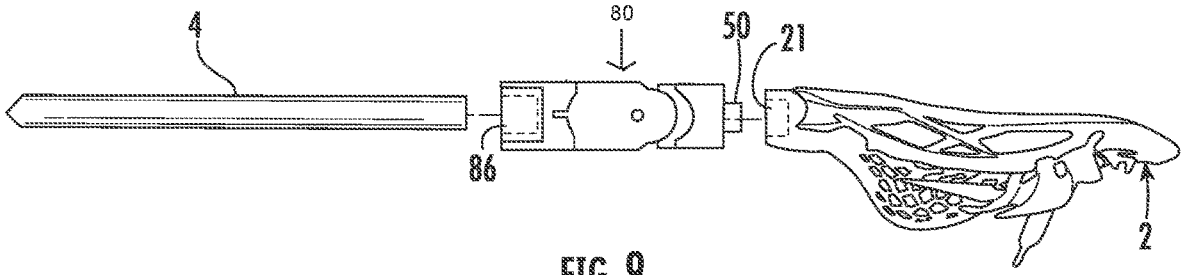
FIG. 9
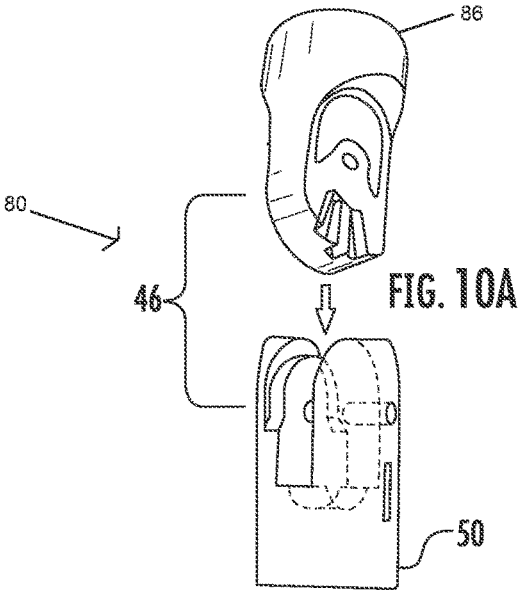
FIG. 10A
FIG. 10B
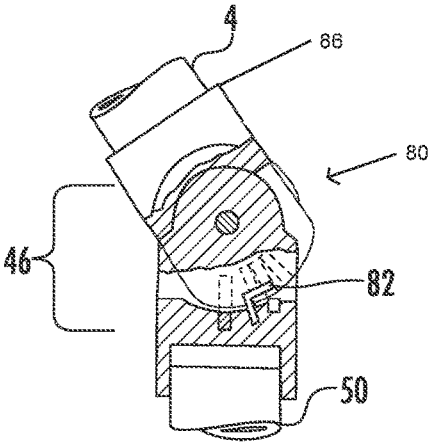
FIG. 10C

EQUIPMENT FEEDBACK SYSTEM

CROSS-REFERENCE TO RELATED APPLICATION

This application claims the benefit of U.S. Provisional Application No. 62/715,852, filed Aug. 8, 2018, which is hereby incorporated by reference in its entirety.

FIELD OF THE INVENTION

This application relates to a device useful in training proper technique for using sporting equipment. In a broad sense, the invention is a feedback system in cooperation with equipment to train users the proper position and/or orientation of the equipment while in use. A particular embodiment of the present invention relates to a lacrosse stick that indicates to the user it is properly positioned to scoop up a lacrosse ball.

BACKGROUND OF THE INVENTION

In many instances, the proper and/or most effective position or orientation for a device (e.g., a tool or sports equipment) must be taught to a user (e.g., the instructee or player) by another person (e.g., the instructor or coach) whom already has achieved the proper technique. Typically, the instructor will observe the instructee performing a task and then correct the instructee. This process would be repeated over and over until the instructee has mastered the proper technique. Even after the instructee masters the technique, the instructor will need to regularly observe the instructee and, if necessary, adjust the instructee's technique if it has changed.

For example, in the sport of lacrosse, coaches train players to use proper technique for scooping up a ground ball. Traditional sporting equipment, however, is passive in that it does not provide direct feedback to the user. The proper technique for picking up a ground ball in lacrosse comprises the player bending her knees so that the head of the lacrosse stick touches the ground and the shaft of the lacrosse stick is at an acute angle with the ground. Ideally, the player is exerting a downward force on the head of the lacrosse stick as the head is slid under the ground ball. When the ground ball is in the net of the lacrosse stick, the player picks the head of the stick up off the ground and runs off. Whether the user used proper technique is indicated by the end result (i.e., whether the ball ended up in the net). This, however, does not provide any feedback to the user during the act and, as such, it is a passive device. Similarly, with a hockey stick, the user may strike a hockey puck with the blade, but if the blade is not properly sitting on the ice from heel to toe, the puck will not be directed to the location intended by the user. Again, passive feedback is provided to the user by the result of the action, not before the action. Similar passive feedback is provided by at least field hockey sticks, golf clubs, and baseball bats.

When an instructor or coach is involved, the passive feedback can be supplemented with the active feedback provided by the instructor or coach. For example, to teach the proper technique for picking up ground balls in lacrosse, the coach must observe whether the player bends her knees, positions the shaft of the lacrosse stick at the proper angle with the ground, and exerts a downward force on the head of the lacrosse stick when in contact with the ground. The coach could then instruct the player to, for example, bend her knees more, increase the angle of the shaft, or other instruction to improve the player's technique. These instructions, however, would be after completion, not simultaneously with the act.

There are additional shortcomings as well. During a game, the bending of the knees, the angle of the shaft, and the head in contact with the ground are generally unobservable. On a crowded field with several players chasing the ball, the coach's view may be obstructed. Furthermore, the fast pace at which the game is played would make it difficult for the coach to observe all three. The same limitations may be present during practices with the added difficulty of having to observe all of the players on the entire team practice ground balls at the same time. In either case, the coach would not be able to observe whether the player is exerting the proper downward force on the head of the lacrosse stick. More importantly, the coach would not be able to provide contemporaneous corrective instruction to the player.

In addition to lacrosse sticks, the feedback system could be used in a wide variety of sporting equipment including, without limitation, field hockey sticks, baseball bats, hockey sticks, golf clubs, tennis rackets, boxing gloves, fencing foils/sabres/epee, archery bows, croquet mallet, darts, cricket bat, and polo mallets/sticks. It could also be used in other equipment, including without limitation power drills, writing utensils, firearms, and industrial equipment.

Problems solved by this invention include, but are not necessarily limited to, problems associated with training users to achieve the proper position and/or orientation of equipment while in use.

BRIEF SUMMARY OF THE INVENTION

An embodiment comprises an equipment feedback apparatus comprising an equipment body, the equipment body comprising a lacrosse stick, the lacrosse stick having a shaft and a head; a power source structure connected to the equipment body; a pressure sensor comprising a tactile switch, the pressure sensor connected to the power source structure, the pressure sensor being configured to trigger when the tactile switch is in a position in which the tactile switch is depressed against a ground; an angle sensor connected to the power source structure, the angle sensor being configured to detect an angle of the shaft of the lacrosse stick relative to the ground; and an indicator connected to the power source structure, the indicator comprising a vibration motor, the indicator being in communication with the pressure sensor and the angle sensor, wherein the indicator is configured to vibrate when: i) the tactile switch is in a position in which the tactile switch is depressed against the ground; and contemporaneously ii) the angle sensor detects the shaft of the lacrosse stick is in a predefined angular range relative to the ground.

In an embodiment, the predefined angular range is adjustable by a user in the field. A vibration of the indicator can provide an indication to a user that the lacrosse stick is in a proper position to pick up a ground ball. An embodiment can further comprise a communication circuit connected to the power source structure, the communication circuit being capable of communicating with a remotely located device. The communication circuit is capable of communicating information received from the pressure sensor and the angle sensor to the remotely located device.

In an embodiment, the predefined angular range relative to the ground falls within an angular range of at least 12° relative to the ground and at most 45° relative to the ground. In an embodiment, the predefined angular range relative to the ground falls within an angular range of at least 8° relative to the ground and at most 35° relative to the ground.

In an embodiment, the power source structure comprises a rechargeable power source located within the equipment body, the rechargeable power source capable of being recharged without removing the rechargeable power source from the equipment body. In an embodiment, the power source structure comprises a power source located within the shaft of the lacrosse stick, the power source having an outer cross-sectional profile that is complementary with an inner cross-sectional profile of the shaft of the lacrosse stick.

An embodiment comprises an equipment feedback apparatus comprising an equipment body; a power source structure connected to the equipment body; a pressure sensor connected to the power source structure; a position sensor connected to the power source structure; and an indicator in communication with the pressure sensor and the position sensor, wherein the indicator is capable of providing an indication to a user that the equipment body is held in a proper position by a user based on information generated by the pressure sensor and the position sensor.

In an embodiment, the equipment body comprises a sports equipment body. In an embodiment, the equipment body comprises a lacrosse stick.

In an embodiment, the position sensor is an angle sensor. In an embodiment, the angle sensor is configured to detect whether a shaft of the lacrosse stick is at a predefined angle relative to the ground. In an embodiment, the predefined angle relative to the ground comprises a predefined angular range relative to the ground. In an embodiment, the predefined angular range relative to the ground falls within an angular range of at least 12° relative to the ground and at most 45° relative to the ground. In an embodiment, the predefined angular range relative to the ground falls within an angular range of at least 8° relative to the ground and at most 35° relative to the ground. In an embodiment, the predefined angular range relative to the ground is adjustable by a user in the field.

In an embodiment, the pressure sensor comprises a tactile switch. In an embodiment, the lacrosse stick has a shaft and a head, and the pressure sensor comprises a deflection sensor interconnecting the shaft and the head, the deflection sensor being configured to detect when the head is deflected. In an embodiment, an operable range of deflection of the head that the deflection sensor is configured to detect is adjustable by a user in the field.

An embodiment further comprises a communication circuit connected to the power source structure, the communication circuit being capable of communicating with a remotely located device. In an embodiment, the power source structure comprises a rechargeable power source located within the equipment body, the rechargeable power source capable of being recharged without removing the rechargeable power source from the equipment body. In an embodiment, the power source structure comprises a power source located within a shaft of the lacrosse stick, the power source having an outer cross-sectional profile that is complementary with an inner cross-sectional profile of the shaft of the lacrosse stick.

An embodiment is a method comprising holding a sports equipment body by a user; detecting a pressure exerted on the sports equipment body; detecting a position of the sports equipment body; and providing an indication to the user that the sports equipment body is held in a proper position by the user based on information generated by the detecting a pressure exerted on the sports equipment body and the detecting a position of the sports equipment body.

In an embodiment, detecting a position of the sports equipment body further comprises detecting an angle of the sports equipment body relative to the ground. An embodiment further comprises communicating the information generated by the detecting a pressure exerted on the sports equipment body and the detecting a position of the sports equipment body to a remotely located device.

An embodiment comprises an equipment feedback apparatus comprising a bridge body, the bridge body having a connecting end and a male protruding end; a pressure sensor connected to the bridge body; a position sensor connected to the bridge body; and an indicator connected to the bridge body and in communication with the pressure sensor and position sensor.

An embodiment further comprises a lacrosse stick shaft, the lacrosse stick shaft capable of being secured to the connecting end. An embodiment further comprises a lacrosse stick head, the lacrosse stick head capable of being secured to the male protruding end. In an embodiment, the position sensor is configured to detect whether the lacrosse stick shaft is in a predefined angular range relative to the ground, and wherein the predefined angular range relative to the ground falls within an angular range of at least 12° relative to the ground and at most 45° relative to the ground.

In an embodiment, the position sensor is configured to detect whether the lacrosse stick shaft is in a predefined angular range relative to the ground, and wherein the predefined angular range relative to the ground falls within an angular range of at least 8° relative to the ground and at most 35° relative to the ground. In an embodiment, the position sensor is configured to detect whether the lacrosse stick shaft is in a predefined angular range relative to the ground, and wherein the predefined angular range relative to the ground is adjustable by a user in the field.

An embodiment further comprises a power source structure connected to the bridge body; and a communication circuit connected to the power source structure, the communication circuit being capable of communicating with a remotely located device. An embodiment further comprises a rechargeable power source located within the bridge body, the rechargeable power source capable of being recharged without removing the rechargeable power source from the bridge body. An embodiment further comprises a power source located within the bridge body, the power source having an outer cross-sectional profile that is complementary with an inner cross-sectional profile of the bridge body.

An embodiment is a kit of parts for an equipment feedback apparatus comprising a bridge body, the bridge body having a connecting end and a male protruding end; the bridge body comprising a pressure sensor, a position sensor and an indicator in communication with the pressure sensor and the position sensor; a lacrosse shaft capable of connecting to the connecting end; and a lacrosse head capable of connecting to the male protruding end.

An embodiment is an equipment feedback apparatus comprising an equipment body; a means for determining whether the equipment body is held at a proper angle; a means for determining whether a proper force is applied to the equipment body; and a means for providing an indication of whether the equipment body is held at a proper angle and whether a proper force is applied to the equipment body based on information generated by the means for determining whether the equipment body is held at a proper angle and the means for determining whether a proper force is applied to the equipment body.

In an embodiment, the means for determining whether the equipment body is held at a proper angle further comprises a means for determining whether a lacrosse stick shaft is in a predefined angular range relative to the ground, and wherein the predefined angular range relative to the ground falls within an angular range of at least 12° relative to the ground and at most 45° relative to the ground. In an embodiment, the means for determining whether the equipment body is held at a proper angle further comprises a means for determining whether a lacrosse stick shaft is in a predefined angular range relative to the ground, and wherein the predefined angular range relative to the ground falls within an angular range of at least 8° relative to the ground and at most 35° relative to the ground. In an embodiment, the means for determining whether the equipment body is held at a proper angle further comprises a means for determining whether a lacrosse stick shaft is in a predefined angular range relative to the ground, and wherein the predefined angular range relative to the ground is adjustable by a user in the field.

An embodiment further comprises a means for communicating to a remotely located device the information generated by the means for determining whether the equipment body is held at a proper angle and the means for determining whether a proper force is applied to the equipment body. An embodiment further comprises a rechargeable power source located within the equipment body, and a means for recharging the rechargeable power source without removing the rechargeable power source from the equipment body. An embodiment further comprises a power source located within the equipment body, the power source having an outer cross-sectional profile that is complementary with an inner cross-sectional profile of the equipment body.

BRIEF DESCRIPTION OF THE SEVERAL VIEWS OF THE DRAWINGS

FIG. 3A is a perspective view of an embodiment of a shaft of a lacrosse stick described herein.

FIG. 3B is a front view of an embodiment of a shaft of a lacrosse stick described herein.

FIG. 4 is a perspective view showing components of an embodiment of a feedback system described herein.

FIG. 9 is a side view showing components of an embodiment of a feedback system described herein.

FIG. 10A is a perspective view showing components of an embodiment of a feedback system described herein.

FIG. 10B is a perspective view showing components of an embodiment of a feedback system described herein.

FIG. 10C is a side view showing components of an embodiment of a feedback system described herein.

DETAILED DESCRIPTION OF THE INVENTION

Figure 1:
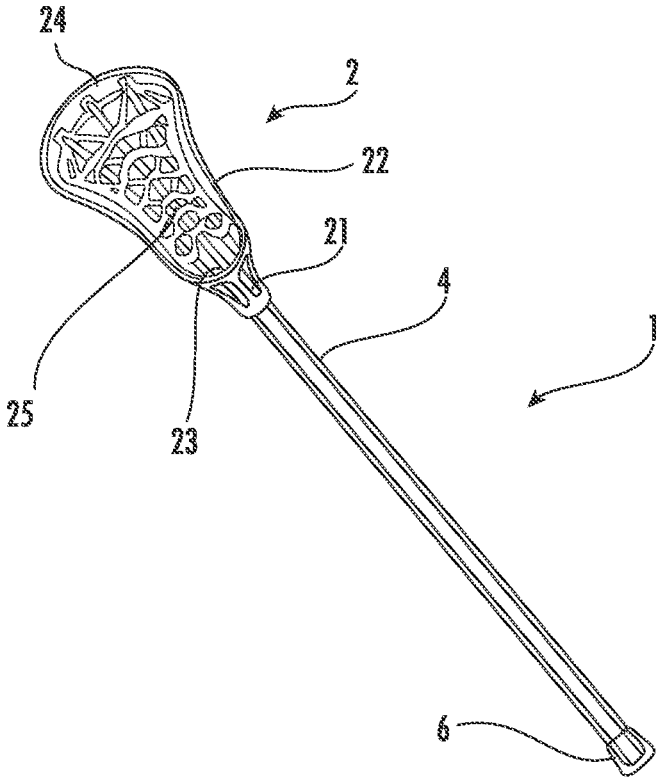
FIG. 1 is a perspective view of an embodiment of a lacrosse stick described herein.

As required, detailed embodiments of the present invention are disclosed herein. However, it is to be understood that the disclosed embodiments are merely exemplary of the invention, which can be embodied in various forms. As such, any feature(s) used in one embodiment can be used in another embodiment. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward.

Alternate embodiments may be devised without departing from the spirit or the scope of the invention. Additionally, well-known elements of exemplary embodiments of the invention will not be described in detail or will be omitted so as not to obscure the relevant details of the invention.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The terms "connected" and/or "coupled," as used herein, are defined as connected, although not necessarily directly, and not necessarily mechanically.

Relational terms such as first and second, top and bottom, and the like may be used solely to distinguish one entity or action from another entity or action without necessarily requiring or implying any actual such relationship or order between such entities or actions. The terms "comprises," "comprising," or any other variation thereof are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

Herein various embodiments of the present invention are described. In many of the different embodiments, features are similar. Therefore, to avoid redundancy, repetitive description of these similar features may not be made in some circumstances. It shall be understood, however, that description of a first-appearing feature applies to the later described similar feature and each respective description, therefore, is to be incorporated therein without such repetition.

Figure 2:
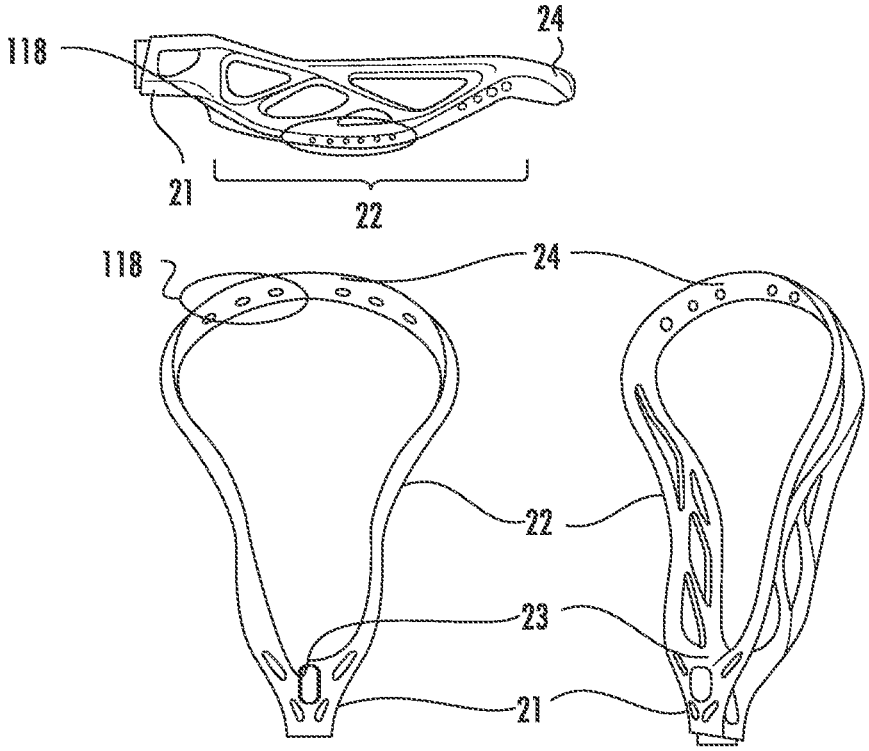
FIG. 2 shows perspective views of an embodiment of the head of a lacrosse stick described herein.

Described now are exemplary embodiments of the present invention. The present invention relates to sporting or other equipment useful in training proper technique. A particular embodiment of the present invention relates to a lacrosse stick that indicates to the user it is properly positioned to scoop up a lacrosse ball. Referring to FIG. 1, an equipment feedback apparatus may include an equipment body, such as a Lacrosse Stick 1. Lacrosse Stick 1 may include a Head 2, Shaft 4 and Butt 6. The Head 2 may be in a generally hourglass shape and includes a Throat 21, Sidewalls 22, a Ball Stop 23, and a Scoop 24. The Head 2 may be made of plastic or any other elastomeric or composite material that is able to resume its near original shape when a deforming force is removed. The Scoop 24 is of a thickness and shape so that it can be slid underneath a lacrosse ball. A Net 25 is secured between Sidewalls 22, Ball Stop 23, and Scoop 24. The Head 2 may also include Holes and/or Projections 118 (see FIG. 2) for attachment of Net 25. Net 25 may be any netting material or meshed fabric sufficient to support a lacrosse ball. Alternatively, as well known in the art, the Net 25 may be constructed from string properly wound to form the Net 25. The Sidewalls 22, Ball Stop 23, and Net 25 essentially form an open container within which the lacrosse ball sits. The Throat 21 may be integrally formed with the Ball Stop 23 and may have a receiving portion to receive the Shaft 4. A screw or other known attachment means may be used to removably attach the Head 2 to the Shaft 4.

Referring to FIGS. 3*a* and 3*b*, the Shaft 4 is generally cylindrical in shape, but is not required to be a round cylinder. The Shaft 4 may be made of wood, metal, fiberglass, or other composite material and may be completely or partially hollow or solid. In a preferred embodiment, the Shaft 4 is made of a lightweight alloy and has a hollow octagonal shape. The Shaft 4 may include Throat End 41, Butt End 42, Shaft Cavity 43, and a Shaft Screw Hole 44. In one embodiment, the Throat End 41 is received by the Throat 21 of the Head 2. The Shaft 4 and Head 2 may be secured together by friction and/or a screw through the Throat 21 into Shaft Screw Hole 41. Butt End 42 may be covered by Butt 6. Butt 6 may be a rubber cap that can be frictionally affixed. As will be discussed below, the Shaft Cavity 43 can be used as the housing for a vibration motor(s), ball angle sensor switch(es) and a power source structure to energize the electrical components. The power source structure may be, for example, a battery, battery holder, or other known structure.

A preferred technique for picking up ground balls in lacrosse requires the user to hold the Shaft 4 with one hand near the Head 2 and the other hand holding the Shaft 4 near the end opposite the Head 2 (i.e., near the Butt End 42). As the player approaches the ball, it is preferred that she lower both hands so that the Head 2 is touching the ground and the Shaft 4 is at an acute angle with the ground. Ideally, the Shaft 4 is at less than a 45° angle from the ground, but this angle is partly dependent on the shape of the Head 2. The user slides the Head 2 along the ground with the Shaft 4 at a proper angle and slides the Head 2 under the ball; all the while pressing the Head 2 down towards the ground. In this invention, the downward force on the Head 2 at the proper angle with the ground is used to detect when the lacrosse stick is in the proper position to scoop up a ball. Once the proper position is detected, the sensor will activate an indicator to provide feedback to the user before the ball is scooped—thereby allowing the user to make adjustments before mishandling the ground ball.

In a preferred embodiment, the lacrosse stick has a position sensor, a pressure sensor and an indicator. Referring to FIG. 4, the position sensor may be, inter alia, a Ball Angle Sensor Switch 106, an inclinometer, or other components known in the art that can be used to determine position and/or orientation. The pressure sensor may be, inter alia, a Tactile Switch 100, pressure meter, variable resistance deformation meter, biased hinge, or other components known in the art that can be used to determine whether the proper pressure or force is being applied. The indicator can be any one or a combination of devices that communicate(s) to the user, including a visual indicator (e.g., light), an audio indicator (e.g., audible sound supplied by a speaker), a motion indicator (e.g., vibration supplied by, for example, a Vibration Motor 104 or linear resonant actuator), or others. The circuit may be powered by any power source, such as Battery 108. In one embodiment, the components are electrically connected by Switch Wire 102, so that if, for example, the Shaft 4 of the lacrosse stick is at a specific angle from the ground and the lacrosse stick Head 2 is pressed into the ground, the vibration motor will be energized and provide an indication to the user that the lacrosse stick is in the proper position.

Figure 5:
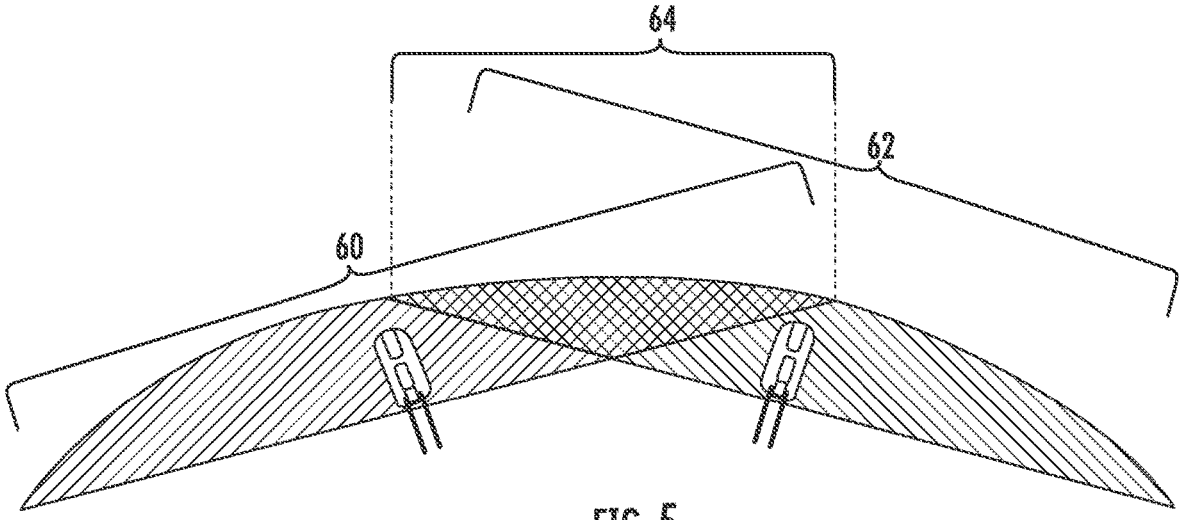
FIG. 5 shows the angular ranges of two angle sensors.

In a preferred embodiment, the Ball Angle Sensor Switch 106 can detect basic orientation and comprises a metal tube within which a metal ball-bearing can roll around. When Ball Angle Sensor Switch 106 is tilted upright, the ball-bearing rolls onto the contacts sticking out of one end and shorts them together—thereby closing the circuit. When Ball Angle Sensor Switch 106 is tilted downward, the ball rolls opposite the contacts resulting in an open circuit. The Ball Angle Sensor Switch 106 has an approximately 180° range when it is ON (i.e., when the ball bearing shorts the contacts) as indicated by First Full Range 60 and Second Full Range 62. Referring to FIG. 5, by combining two Ball Angle Sensor Switches 106, an operative range that is less than 180° can be defined as indicated by Partial Range 64. In doing so, when the Ball Angle Sensor Switches 106 are housed in the Shaft 4 of the lacrosse stick, the optimal angular range for picking up a ground ball can be selected. In this embodiment, for example, the Ball Angle Sensor Switch 106 reacts (i.e. the circuit of the Ball Angle Sensor Switch 106 either opens or closes) based on the angle of the Ball Angle Sensor Switch 106 relative to gravity. However, since most lacrosse fields and most other playing surfaces are substantially flat and substantially horizontal (relative to gravity), by the circuit of the Ball Angle Sensor Switch 106 either opening or closing based on the angle of the Shaft 4 relative to gravity, the Ball Angle Sensor Switch 106 provides an indication of the angle of the Shaft 4 relative to the ground. Accordingly, since the Ball Angle Sensor Switch 106 is configured to detect the angle of the Shaft 4 of the lacrosse stick relative to gravity, the Ball Angle Sensor Switch 106 is also considered to be configured to detect the angle of the Shaft 4 relative to the ground.

Referring still to FIG. 5, generally, the Partial Range 64 would correspond to the Shaft 4 of the lacrosse stick being between 15° and 30° with the ground. This angular range, however, may also take into consideration the length of the lacrosse stick 72, which may impact the angular range. In men's lacrosse, lacrosse sticks (i.e., the total length of the Shaft 4 and Head 2) can range from approximately 40 inches to 72 inches long. In women's lacrosse, the sticks can range from approximately 35 ½ inches to 43 ¼ inches long.

Figure 6:
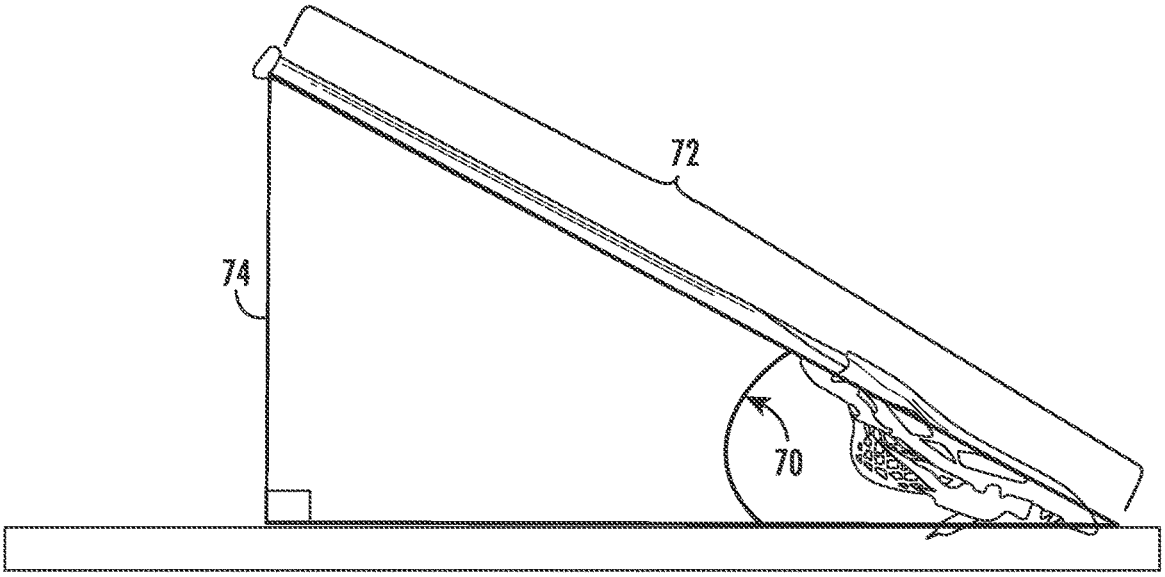
FIG. 6 is a side view of an embodiment of a lacrosse stick described herein.

In one embodiment (see FIG. 6), a preferred angular range may be calculated by knowing the length of the lacrosse stick (Shaft 4 plus Head 2) 72 and the preferred high and low distances of the Butt End 42 of the Shaft 4 from the ground (i.e. Height 74). In a preferred embodiment, the Butt End 42 of the lacrosse stick would be between 11 inches and 26 inches above the ground (i.e. the Height 74 is between 11 and 26 inches from the ground). As shown in the calculations below, if using a 40-inch lacrosse stick, the preferred angular range is 15.96° to 40.54°.

| Low end of Range (40 inch lacrosse stick) | High end of Range (40 inch lacrosse stick) |
|---|---|
| Sin Theta = Opposite/Hypotenuse | |
| Sin Theta = (Distance from ground to Butt End 42)/(Length of Lacrosse Stick) | |
| Sin Theta = 11/40 = 0.275 | Sin Theta = 26/40 |
| $Sin^{-1}$ 0.275 = 15.96° | $Sin^{-1}$ 0.65 = 40.54° |

The calculation of the preferred angular range is dependent on the length of the lacrosse stick. For example, the same calculation with a 72-inch lacrosse stick would result in a preferred angular range of 8.8° to 21.2°, which may result in the shaft 4 being too low to the ground:

| Low end of Range (72 inch lacrosse stick) | High end of Range (72 inch lacrosse stick) |
|---|---|
| Sin Theta = Opposite/Hypotenuse | |
| Sin Theta = (Distance from ground to Butt End 42)/(Length of Lacrosse Stick) | |
| Sin Theta = 11/72 = 0.152 | Sin Theta = 26/72 |
| $Sin^{-1}$ 0.275 = 8.8° | $Sin^{-1}$ 0.361 = 21.17° |

In the case with the 72-inch lacrosse stick, the calculated range of 8.8° to 21.17° may not be the preferred range because of the dependence on the length of the lacrosse stick. Accordingly, in a further preferred embodiment, the distance from the ground to the player's hand (on the Shaft 4 closest to the Butt End 42) would be used to calculate the preferred angular range. In this embodiment the length of the Shaft 4 and the distance to the ground would be smaller. Using the player's hand position is preferred because a goal of this embodiment is to encourage a player to get low by bending his knees and if the player's hand is in a different position than the Butt End 42, the player may not be in the optimal position even when the lacrosse stick is in the preferred angular range. The calculation of the preferred angular range in this embodiment is shown below:

| Low end of Range (72 inch lacrosse stick) | High end of Range (72 inch lacrosse stick) |
|---|---|
| Sin Theta = Opposite/Hypotenuse | |
| Sin Theta = (Distance from ground to Player's hand closest to Butt End 42)/(Distance from Scoop 24 to Player's hand closest to Butt End 42) | |
| Sin Theta = 11/50 = 0.22 | Sin Theta = 26/50 |
| $Sin^{-1}$ 0.275 = 12.7° | $Sin^{-1}$ 0.52 = 31.3° |

An embodiment of the invention can include three Ball Angle Sensor Switches 106. The first Ball Angle Sensor Switch can set the maximum angle, the second Ball Angle Sensor Switch can set the minimum angle, and a third Ball Angle Sensor Switch can act as a check sensor that confirms the angle is between the minimum and maximum angles.

The pressure sensor in a preferred embodiment is a tactile switch 100. Tactile switches typically have a default OFF (i.e., open circuit) setting and have a temporary ON (i.e., closed circuit) position. When the button is pressed the circuit closes and when the button is released the circuit opens.

In a preferred embodiment, the pressure sensor would detect the amount of pressure being exerted by using a flex sensor. As the flex sensor is flexed, the resistance across the sensor increases. Control circuitry would operate an ON/OFF switch depending on the resistance of the flex sensor. In one embodiment, the player could set the circuit to a predetermined resistance range, which would correspond to a specific range of force used to press the Head 2 into the ground. In a further embodiment, the pressure switch may be specific to the surface on which it is being used. For example, a small tactile switch may be preferred when playing lacrosse on a hard surface, but would not be preferred on a soft natural grass field. On the soft natural grass field, a larger button may be preferred to ensure it is depressed when in contact with the grass. In another embodiment, the pressure switch is changeable so that a user could select the appropriate pressure switch for any surface (e.g., turf, grass, hard laminate, and others). These pressure switch options could be included in a kit.

The indicator in a preferred embodiment is a Vibration Motor 104. When energized, the Vibration Motor 104 spins an unbalanced mass, thereby creating a force that translates to vibrations. The vibrations can be felt by the player holding the lacrosse stick. The invention contemplates a single vibration motor or more than one vibration motor. Also, the Vibration Motor 104 may be placed anywhere in the Shaft 4, in the Head 2, or both. In an alternative embodiment, the indicator is remotely located from the lacrosse stick (e.g., in the Player's glove). This alternative embodiment would be particularly useful in men's lacrosse because the players wear thick gloves that may dampen the vibrations if the indicator is located within the lacrosse stick. The indicator could also be remotely located in the player's helmet. In this embodiment, the indicator would preferably be a speaker that emits an audible tone when the lacrosse stick is in the proper position to pick up the ball.

In a further preferred embodiment, the indicator may be a light in a position on the lacrosse stick visible to the user. When the lacrosse stick is in the proper position with proper downward pressure, the light would be energized. Preferably, the light would be a light emitting diode, but it could be any small light source. In one embodiment, the light blinks.

Figure 7:
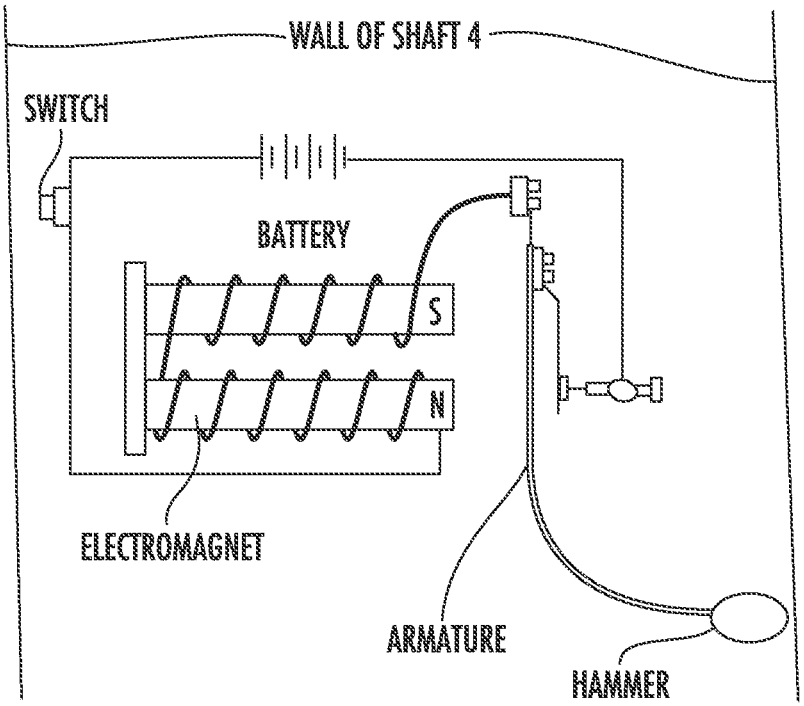
FIG. 7 is a plan view showing components of an embodiment of a feedback system described herein.

Referring to FIG. 7, another embodiment uses an electromagnetic hammer as the indicator. These devices are used in doorbells and alarm clocks to ring a bell, but in this application the hammer could strike the inside wall of the Shaft 4. The rapid striking would cause an audible sound and a vibration in the Shaft 4.

Figure 8:
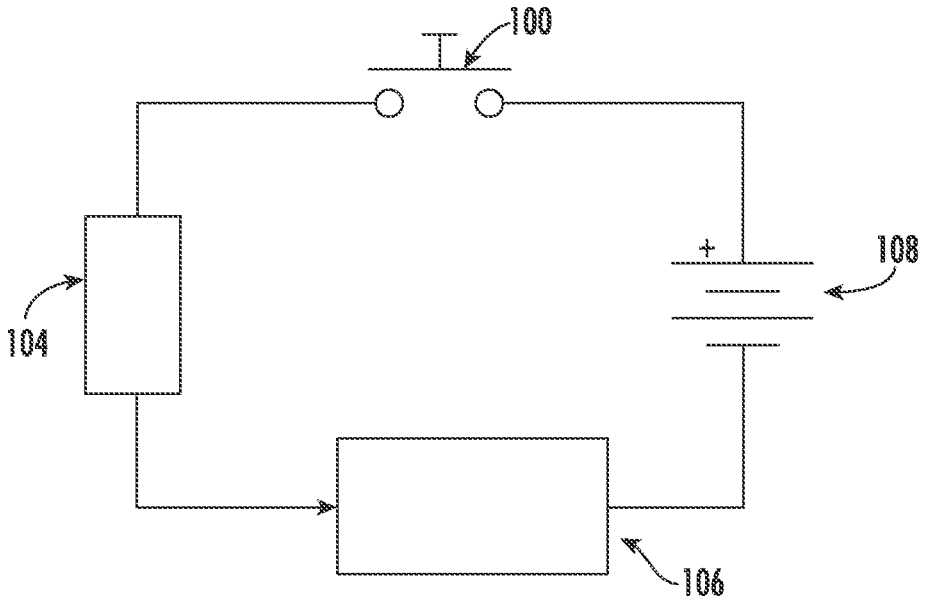
FIG. 8 is a plan view showing components of an embodiment of a feedback system described herein.

In another embodiment, the circuit (as shown in FIG. 8) comprises a Battery 108, Tactile Switch 100, Ball Angle Sensor Switch 106 and Vibration Motor 104 connected in serial. Referring again to FIG. 4, the Switch Wire 102 can run along the wall of the Head 2 or may run along a channel in the Head 2. The head channel may be a groove in the wall of the Head 2 or may be an enclosed conduit. The Switch Wire 102 may extend into the Shaft Cavity 43 to connect to the other components. The Switch Wire 102 may include a connector cable. An on/off switch may also be included in the circuit.

In a further embodiment, a Deflection Sensor Switch can be mounted between the Shaft 4 and Head 2 using a Bridge 80. In this embodiment, the Shaft 4 is removed from the Throat 21 and the Shaft 4 is inserted into Bridge Throat 86. A Head Post 50 is inserted into the Throat 21 and secured. Bridge Throat 86 receives Shaft 4 to secure Shaft 4 to Bridge 80. Alternatively, instead of the Bridge 80 having a Bridge Throat 86, the Bridge 80 can have a protrusion, with the protrusion being insertable into the Shaft 4 to secure the Bridge 80 to the Shaft 4. The Bridge Throat 86 and the Head Post 50 are connected by a Hinge 46. This allows existing lacrosse sticks to be retrofitted with an embodiment of the invention. When at rest, the Shaft 4, Deflection Sensor Switch 82, and Throat 21 are coaxial. In this embodiment, the Head 2 is movable with respect to Deflection Sensor 82 when a force is exerted on the Head 2. Referring to FIG. 9, the Deflection Sensor Switch 82 would include a biased hinge. The biased hinge includes a spring that exerts a force to maintain the Head 2 and Shaft 4 in a coaxial relationship. In operation, when the proper force is applied to the Head 2, it would cause the hinge to deflect. The deflection, in turn, would be detected by Deflection Sensor Switch 82 and the indicator would be activated (if contemporaneously the shaft is at the proper angle as detected by, for example, the Ball Angle Sensor Switch 106).

In an embodiment, the invention can include a flexing portion of the Head 2. The flexing of the Head 2 may be facilitated by the elastomeric materials used to manufacture the Head 2 or by including a hinge in the Head 2.

In another embodiment, one or more of the operable ranges are adjustable. For example, the angular range of the lacrosse stick with respect to the ground may be adjustable to increase or decrease the range. This may be accomplished by changing the angles of one or both of the Ball Angle Sensor Switches 106 or providing control inclinometer circuitry that would change the operable range. The pressure sensor could also be variable. For example, control circuitry for a flex sensor could allow selection of the operable pressure ranges. The adjustability of the settings would be beneficial to players because it would allow players to fine tune their technique and would account for variations in the playing field surface, the different forces exerted on men's and women's lacrosse sticks, and the variation in flexibility of different lacrosse sticks heads. As used herein, "adjustable by a user in the field" means the feedback system is designed and configured in such a way that the setting of the value at issue that is detected (e.g., angle, amount of pressure applied, amount of force applied, position, orientation, etc., or the operable range of any of the foregoing) is intended to be adjustable by an end user (e.g., a lacrosse player) in the field (e.g., on a lacrosse field or on the sidelines of a lacrosse field).

In another embodiment, instead of or in addition to the feedback system of the invention providing an indication that the equipment, such as a lacrosse stick, is in a proper position, the feedback system can provide an indication that the lacrosse stick is in an improper position. This can include one or more indications that inform a user of the specific reason the lacrosse stick is in an improper position. For example, an embodiment of the feedback system can have four indicators, with each one of the indicators being a different colored light (e.g., a red indicator light, a blue indicator light, a purple indicator light, and a yellow indicator light). A feedback system such as this can inform a user of the specific reason the lacrosse stick is in an improper position by, for example, activating the red indicator light when the angle of the Shaft 4 of the lacrosse stick relative to the ground is too shallow, activating the blue indicator light when the angle of the Shaft 4 of the lacrosse stick relative to the ground is too step, activating the purple indicator light when the head of the lacrosse stick is deflected too much, and activating the yellow indicator light when the head of the lacrosse stick is deflected too little. In such an embodiment, in the event there are two or more reasons the lacrosse stick is in an improper position, two or more of the corresponding indicator lights can be activated as is applicable. An embodiment such as this can also include a fifth indicator light, e.g., a green indicator light, which can be activated in the event that the lacrosse stick is in the proper position.

In another embodiment, the exterior shape of the power source (e.g., battery or battery holder) would have approximately the same shape or exactly the same shape as the inside wall of the Shaft 4. For example, in the preferred embodiment having the Shaft 4 with a hollow octagonal shape, the power supply would be slightly smaller and would be received by the Shaft 4. The complementary shapes would result in the power source being securely seated in position allowing the lacrosse stick to be struck, swung, and otherwise impacted and moved without the power source moving substantially. The term battery holder includes any structure for electrically connecting a battery to the circuit and includes wires capable of connecting to a battery.

In other embodiments, the shapes of the indicator, the sensor switch, the power source, or any combination of those have approximately the same shape or exactly the same shape as the inside wall of the Shaft 4. For example, in the preferred embodiment having the Shaft 4 with a hollow octagonal shape, the Indicator, the sensor switch, the power source, or any combination of those would be slightly smaller and would be received by the Shaft 4. For example, referring to FIGS. 3B and 4, the Shaft 4 has an inner cross-sectional profile 66 that is complementary with the outer cross-sectional profile 105 of the indicator (i.e. vibration motor 104). Complementary shapes such as these can result in the indicator, the sensor switch, the power source, or any combination of the those being securely seated in position allowing the lacrosse stick to be struck, swung, and otherwise impacted and moved without moving substantially.

The power source may be hard wired to the circuit or may be connected via a connection mechanism well known in the industry (e.g., a battery holder or quick connect).

In a further embodiment, the power source is recharged via an accessible electrical port into which a charging plug could be inserted. In this embodiment, the electrical port would extend out through the Shaft 4, Head 2, or Butt 6. In addition, the port could be accessible by removing the Butt 6. In another embodiment, the power source can be recharged using wireless charging technology that is well-known technology. The invention also contemplates the power source being a battery that can be changed or recharged externally.

The invention may be used in instructional drills during a team practice. In one embodiment, the drill may require a player to keep the lacrosse stick in the proper position for picking up a ball while running across the playing field. A player that fails to keep her stick in the proper position is eliminated from the drill until only one player remains. In another embodiment, each player would repeatedly put the lacrosse stick in the proper position, receive the feedback, and then raise the stick off the ground. The drill could include a time period and/or a target number of times the lacrosse stick is properly positioned.

In another embodiment, the indicator, the sensor, the power source, or any combination of those components are secured in a variety of sleeves. The sleeves would have the same interior shape for receiving one or more components, but the exterior of the sleeves would coincide with the different shapes of the interior of the Shafts 4. This would allow a user to add the invention to any lacrosse stick despite the shape of the Shaft 4, simply by using one of the several sleeves that are sold together with the invention.

In another embodiment, the lacrosse stick may include a one-way or two-way communication circuit. For example, a one way communication circuit could transmit to a remote receiver when the lacrosse stick was placed in the proper position to pick up a lacrosse ball. The data could be collected and used by a coach to assist in providing instruction to a player. The two-way communication circuit would allow the lacrosse stick's circuitry to transmit to a remote receiver when the lacrosse stick was placed in the proper position to pick up a lacrosse ball and would be able to receive data as well. The reception of data would assist the coach in communicating with the player remotely—for example, if the coach noticed the player was not bending her knees, a reminder (e.g., making the stick vibrate three times) could be transmitted to the lacrosse stick by the coach. The communication circuitry can communicate using well known communication technology such as, radio signals, Bluetooth (near field communications), WiFi networks, or the like.

The circuitry and power source onboard the lacrosse stick also enables the incorporation of additional circuitry. For example, one embodiment includes a location tracker circuit (e.g., GPS circuitry). The location of the player would be recorded on-board the lacrosse stick and/or transmitted to a remote receiver throughout the entire game or practice. The data could then be used for analytic purposes.

The invention has uses in baseball, as well. When a player is in her batting stance, the angle of the bat can determine how she hits the ball. A player that can consistently hold the bat at nearly the same angle will have better results. By holding the bat straight up and down (perpendicular to the ground) there can be more power generated from this position because with the extra length in the back part of the swing creates a longer space to increase bat speed. By holding the bat flat (parallel to the ground) the back part of the swing will be shorter and more direct to the ball meaning the player will not generate as much power because the bat is traveling a shorter distance. The present invention would allow the player to select between a longer more powerful swing and a quicker less powerful swing. The invention would allow the player to set a target range anywhere between perpendicular and parallel to the ground, so that she could accurately repeat the desired angle every time. In this case, for example, the Tactile Switch 100 would be closed. When the player grips the bat with both hands in the proper position and when the bat is placed in the proper orientation, the indicator would be energized.

The invention has uses in tool equipment (e.g., a drill). Oftentimes a user desires to drill a hole at a specific angle. In a preferred embodiment, an orientation sensor switch could be set to a specific angle or angular range. When the drill is held in the proper position, the indicator would be energized. In operation, in one embodiment, the user would set the angle to 0° to drill a horizontal hole. The user would then grip the drill (thereby closing tactile switch 100) and place the drill at a 0° angle. The indicator, a light in this embodiment, would then become energized. The light would stay lit as long as the drill was at 0° and the tactile switch 100 is depressed.

The foregoing description and accompanying drawings illustrate the principles, exemplary embodiments, and modes of operation of the invention. However, the invention should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the invention.

What is claimed is:

1. A lacrosse stick comprising:

a) a shaft and a head, the shaft and head attached to each another;

b) a power source structure connected to the lacrosse stick;

c) a pressure sensor comprising a tactile switch, the pressure sensor connected to the power source structure, the pressure sensor being configured to trigger when the tactile switch is in a position in which the tactile switch is depressed against a ground;

d) an angle sensor connected to the power source structure, the angle sensor being configured to detect an angle of the shaft of the lacrosse stick relative to the ground; and e) an indicator connected to the power source structure, the indicator comprising a vibration motor, the indicator being in communication with the pressure sensor and the angle sensor, wherein the indicator is configured to vibrate when:

i) the tactile switch is in a position in which the tactile switch is depressed against the ground; and at the same time ii) the angle sensor detects the shaft of the lacrosse stick is in a predefined angular range relative to the ground;

wherein the vibration occurs while the lacrosse stick is in use so that a user can make adjustments during use.

2. The lacrosse stick of claim 1, wherein the predefined angular range is adjustable by a user in the field.

3. The lacrosse stick of claim 1, wherein a vibration of the indicator provides an indication to a user that the lacrosse stick is in a proper position to pick up a ground ball.

4. The lacrosse stick of claim 1 further comprising a communication circuit connected to the power source structure, the communication circuit being capable of communicating with a remotely located device.

5. The lacrosse stick of claim 4, wherein the communication circuit is capable of communicating information received from the pressure sensor and the angle sensor to the remotely located device.

6. The lacrosse stick of claim 1, wherein the predefined angular range relative to the ground falls within an angular range of at least 12° relative to the ground and at most 45° relative to the ground.

7. The lacrosse stick of claim 1, wherein the predefined angular range relative to the ground falls within an angular range of at least 8° relative to the ground and at most 35° relative to the ground.

8. The lacrosse stick of claim 1, wherein the power source structure comprises a rechargeable power source located within the equipment body, the rechargeable power source capable of being recharged without removing the rechargeable power source from the equipment body.

9. The lacrosse stick of claim 1, wherein the power source structure comprises a power source located within the shaft of the lacrosse stick, the power source having an outer cross-sectional profile that is complementary with an inner cross-sectional profile of the shaft of the lacrosse stick.

10. An equipment feedback apparatus comprising:

a) an equipment body;

b) a power source structure connected to the equipment body;

c) a pressure sensor connected to the power source structure; the pressure sensor triggering when the proper pressure is sensed;

d) a position sensor connected to the power source structure; the position sensor triggering when the proper position is sensed; and e) an indicator in communication with the pressure sensor and the position sensor, wherein the indicator is capable of providing an indication to a user when the pressure sensor and position sensor are triggered at the same time;

wherein the indication is received by the user while the equipment body is in use so that the user can make adjustments during use, wherein the equipment body comprises a lacrosse stick.

11. The equipment feedback apparatus of claim 10, wherein the position sensor is an angle sensor.

12. The equipment feedback apparatus of 11, wherein the angle sensor is configured to detect whether a shaft of the lacrosse stick is at a predefined angle relative to the ground.

13. The equipment feedback apparatus of claim 12, wherein the predefined angle relative to the ground comprises a predefined angular range relative to the ground.

14. The equipment feedback apparatus of claim 13, wherein the predefined angular range relative to the ground falls within an angular range of at least 12° relative to the ground and at most 45° relative to the ground.

15. The equipment feedback apparatus of claim 13, wherein the predefined angular range relative to the ground falls within an angular range of at least 8° relative to the ground and at most 35° relative to the ground.

16. The equipment feedback apparatus of claim 13, wherein the predefined angular range relative to the ground is adjustable by a user in the field.

17. The equipment feedback apparatus of claim 10, wherein the pressure sensor comprises a tactile switch.

18. The equipment feedback apparatus of claim 10, wherein the lacrosse stick has a shaft and a head, and wherein the pressure sensor comprises a deflection sensor interconnecting the shaft and the head, the deflection sensor being configured to detect when the head is deflected.

19. The equipment feedback apparatus of claim 18, wherein an operable range of deflection of the head that the deflection sensor is configured to detect is adjustable by a user in the field.

20. The equipment feedback apparatus of claim 10, wherein the power source structure comprises a power source located within a shaft of the lacrosse stick, the power source having an outer cross-sectional profile that is complementary with an inner cross-sectional profile of the shaft of the lacrosse stick.

21. An equipment feedback apparatus comprising:

a) an equipment body;

b) a power source structure connected to the equipment body;

c) a pressure sensor connected to the power source structure; the pressure sensor triggering when the proper pressure is sensed;

d) a position sensor connected to the power source structure; the position sensor triggering when the proper position is sensed; and e) an indicator in communication with the pressure sensor and the position sensor, wherein the indicator is capable of providing an indication to a user when the pressure sensor and position sensor are triggered at the same time;

wherein the indication is received by the user while the equipment body is in use so that the user can make adjustments during use and further comprising a communication circuit connected to the power source structure, the communication circuit being capable of communicating with a remotely located device.

22. An equipment feedback apparatus comprising:

a) an equipment body;

b) a power source structure connected to the equipment body;

c) a pressure sensor connected to the power source structure; the pressure sensor triggering when the proper pressure is sensed;

d) a position sensor connected to the power source structure; the position sensor triggering when the proper position is sensed; and e) an indicator in communication with the pressure sensor and the position sensor, wherein the indicator is capable of providing an indication to a user when the pressure sensor and position sensor are triggered at the same time;

wherein the indication is received by the user while the equipment body is in use so that the user can make adjustments during use, wherein the power source structure comprises a rechargeable power source located within the equipment body, the rechargeable power source capable of being recharged without removing the rechargeable power source from the equipment body.

23. A method of providing feedback to a user comprising:

a) holding a sports equipment body by a user;

b) detecting a pressure exerted on the sports equipment body;

c) detecting a position of the sports equipment body; and d) providing an indication to the user that the sports equipment body is held in a proper position by the user based on a pressure trigger generated by the detecting a pressure exerted on the sports equipment body and at the same time a position trigger generated by the detecting a position of the sports equipment body;

wherein the indication is received by the user while the sports equipment body is in use so that the user can make adjustments during use, wherein detecting a position of the sports equipment body further comprises detecting an angle of the sports equipment body relative to the ground.

24. A method of providing feedback to a user comprising:

a) holding a sports equipment body by a user;

b) detecting a pressure exerted on the sports equipment body;

c) detecting a position of the sports equipment body; and d) providing an indication to the user that the sports equipment body is held in a proper position by the user based on a pressure trigger generated by the detecting a pressure exerted on the sports equipment body and at the same time a position trigger generated by the detecting a position of the sports equipment body;

wherein the indication is received by the user while the sports equipment body is in use so that the user can make adjustments during use, and further comprising communicating the triggers generated by the detecting a pressure exerted on the sports equipment body and the detecting a position of the sports equipment body to a remotely located device.

25. An equipment feedback apparatus comprising:

a) a bridge body, the bridge body having a connecting end and a male protruding end;

b) a pressure sensor connected to the bridge body; the pressure sensor capable of triggering when the proper pressure is sensed;

c) a position sensor connected to the bridge body; the position sensor capable of triggering when the proper position is sensed; and d) an indicator connected to the bridge body and in communication with the pressure sensor and position sensor;

wherein the indicator provides an indication to the user when the pressure sensor and position sensor are triggered at the same time and while the bridge body is in use so that the user can make adjustments during use.

26. The equipment feedback apparatus of claim 25 further comprising a lacrosse stick shaft, the lacrosse stick shaft capable of being secured to the connecting end.

27. The equipment feedback apparatus of claim 25 further comprising a lacrosse stick head, the lacrosse stick head capable of being secured to the male protruding end.

28. The equipment feedback apparatus of claim 26, wherein the position sensor is configured to detect whether the lacrosse stick shaft is in a predefined angular range relative to the ground, and wherein the predefined angular range relative to the ground falls within an angular range of at least 12° relative to the ground and at most 45° relative to the ground.

29. The equipment feedback apparatus of claim 26, wherein the position sensor is configured to detect whether the lacrosse stick shaft is in a predefined angular range relative to the ground, and wherein the predefined angular range relative to the ground falls within an angular range of at least 8° relative to the ground and at most 35° relative to the ground.

30. The equipment feedback apparatus of claim 26, wherein the position sensor is configured to detect whether the lacrosse stick shaft is in a predefined angular range relative to the ground, and wherein the predefined angular range relative to the ground is adjustable by a user in the field.

31. The equipment feedback apparatus of claim 25 further comprising:

a) a power source structure connected to the bridge body; and b) a communication circuit connected to the power source structure, the communication circuit being capable of communicating with a remotely located device.

32. The equipment feedback apparatus of claim 25 further comprising a rechargeable power source located within the bridge body, the rechargeable power source capable of being recharged without removing the rechargeable power source from the bridge body.

33. The equipment feedback apparatus of claim 25 further comprising a power source located within the bridge body, the power source having an outer cross-sectional profile that is complementary with an inner cross-sectional profile of the bridge body.

34. A kit of parts for an equipment feedback apparatus comprising:

a) a bridge body, the bridge body having a connecting end and a male protruding end; the bridge body comprising a pressure sensor, the pressure sensor triggering when the proper pressure is sensed; a position sensor, the position sensor triggering when the proper position is sensed; and an indicator in communication with the pressure sensor and the position sensor;

b) a lacrosse shaft capable of connecting to the connecting end; and c) a lacrosse head capable of connecting to the male protruding end;

wherein the indicator provides an indication to the user when the pressure sensor and position sensor are triggered at the same time and while the bridge body is in use so that the user can make adjustments during use.

35. An equipment feedback apparatus comprising:

a) an equipment body;

b) a means for determining whether the equipment body is held at a proper angle;

c) a means for determining whether a proper force is applied to the equipment body; and d) a means for providing an indication of whether the equipment body is held at a proper angle and at the same time whether a proper force is applied to the equipment body based on information generated by the means for determining whether the equipment body is held at a proper angle and the means for determining whether a proper force is applied to the equipment body;

wherein the indication is received by the user while the equipment body is in use so that the user can make adjustments during use.

36. The equipment feedback apparatus of claim 35, wherein the means for determining whether the equipment body is held at a proper angle further comprises a means for determining whether a lacrosse stick shaft is in a predefined angular range relative to the ground, and wherein the predefined angular range relative to the ground falls within an angular range of at least 12° relative to the ground and at most 45° relative to the ground.

37. The equipment feedback apparatus of claim 35, wherein the means for determining whether the equipment body is held at a proper angle further comprises a means for determining whether a lacrosse stick shaft is in a predefined angular range relative to the ground, and wherein the predefined angular range relative to the ground falls within an angular range of at least 8° relative to the ground and at most 35° relative to the ground.

38. The equipment feedback apparatus of claim 35, wherein the means for determining whether the equipment body is held at a proper angle further comprises a means for determining whether a lacrosse stick shaft is in a predefined angular range relative to the ground, and wherein the predefined angular range relative to the ground is adjustable by a user in the field.

39. The equipment feedback apparatus of claim 35 further comprising a means for communicating to a remotely located device the information generated by the means for determining whether the equipment body is held at a proper angle and the means for determining whether a proper force is applied to the equipment body.

40. The equipment feedback apparatus of claim 35 further comprising a rechargeable power source located within the equipment body, and a means for recharging the rechargeable power source without removing the rechargeable power source from the equipment body.

41. The equipment feedback apparatus of claim 35 further comprising a power source located within the equipment body, the power source having an outer cross-sectional profile that is complementary with an inner cross-sectional profile of the equipment body.

* * * * *